United States Patent [19]

Buchberger

[11] Patent Number: 4,545,640

[45] Date of Patent: Oct. 8, 1985

[54] ELECTRICAL SPLICING CONNECTOR

[75] Inventor: Harold W. Buchberger, North Lake, Wis.

[73] Assignee: Curtis Industries, Milwaukee, Wis.

[21] Appl. No.: 555,174

[22] Filed: Nov. 25, 1983

[51] Int. Cl.[4] ..... H01R 4/36

[52] U.S. Cl. ..... 339/272 R

[58] Field of Search ..... 339/272, 276 SF, 263 R

[56] References Cited

U.S. PATENT DOCUMENTS

| | | | |
|---|---|---|---|
| 2,732,535 | 1/1956 | Hammerly | 339/272 UC |
| 2,885,654 | 5/1959 | Norden | 339/272 UC |
| 2,900,688 | 8/1959 | Hicks, Jr. | 339/272 UC |
| 3,638,172 | 1/1972 | Adam | 339/272 R |
| 4,415,223 | 11/1983 | Asick | 339/276 R |

FOREIGN PATENT DOCUMENTS

| | | | |
|---|---|---|---|
| 2916292 | 10/1980 | Fed. Rep. of Germany | 339/272 A |

*Primary Examiner*—Gil Weidenfeld

*Assistant Examiner*—David L. Pirlot

*Attorney, Agent, or Firm*—Wheeler Law Firm

[57] ABSTRACT

An electrical connector of the type which includes a rectangular sleeve folded from a flat blank and a pair of screws penetrating one side of the sleeve to clamp electrical wires against an opposite side of the sleeve is protected against distortion by the provision of a dovetail slot in one side intersecting an edge of that side and the provision of a complementary dovetail on a side of the rectangular connector sleeve which meets the side having the dovetail slot at the edge intersected by the dovetail slot so that the complementary dovetail may be folded into the dovetail slot to resist unfolding. The dovetail slot and complementary dovetail are so oriented that the force of tightening the screws against the electrical wires or other conductors is resisted by the dovetail so that the rectangular sleeve cannot unfold. This allows the screws to develop more clamping force against the electrical conductor making a better, neater and safer connection.

4 Claims, 3 Drawing Figures

ELECTRICAL SPLICING CONNECTOR

BACKGROUND OF THE INVENTION

This invention relates to an electrical splicing connector having a rectangular sleeve made by folding a blank in five panels so that the first and fifth panels lap. The sleeve has threaded openings for screws used to secure electric conductors in the sleeve. As previously made these connectors have a tendency to come apart under the force of the tightening of the screws which secure the electric wires. This limits the extent to which the screws may be tightened against the conductor or wire.

SUMMARY OF THE INVENTION

The invention consists of the provision of a dovetail slot at one edge of a side and of a dovetail matching the dovetail slot at one end of the blank, forming a sixth side of the blank which is later folded to form the rectangular sleeve of the connector, in such a fashion that the dovetail projection is folded into the dovetail slot as the blank is folded to form the rectangular sleeve. The dovetail preferably lies in a plane parallel to the plane in which the axis of the screw lies. This provides a means of opposing the force generated by tightening screws against the electrical wires, allowing the screws to be clamped more tightly, making a better electrical connection, and guarding against the unfolding of the rectangular sleeve.

DETAILED DESCRIPTION

Figure 1:
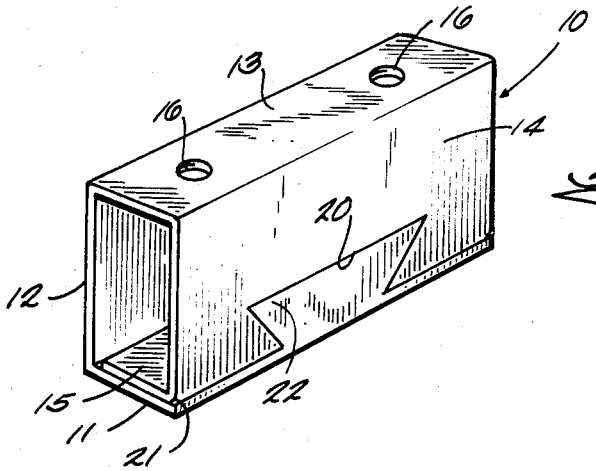
FIG. 1 is a perspective view of the rectangular sleeve of my improved electrical splicing connector.

Although the disclosure hereof is detailed and exact to enable those skilled in the art to practice the invention, the physical embnodiments herein disclosed merely exemplify the invention which may be embodied in other specific structure. While the best known embodiment has been described, the details may be changed without departing from the invention which is defined by the claims.

The connector of my invention consists of a rectangular body or sleeve 10 having four panels or sides 11, 12, 13, and 14 and a fifth panel 15 which folds inside side 11.

A pair of threaded holes 16 receive contact screws 17 so that they may be screwed in to advance upon and clamp electrical conductors 18. These might be the stripped end of a heavy wire, an electrical connector on the end of a wire, or the like. It will be understood that other means of providing threads for screws 17 could be adopted, such as nuts inside of side 13, but the preferred form has threads in the hole 16 itself.

Figure 2:
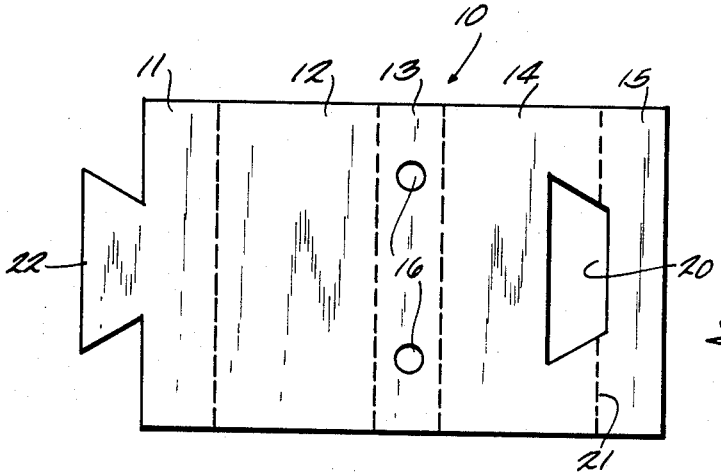
FIG. 2 is a plan view of the blank used to form the unit of FIG. 1.
Figure 3:
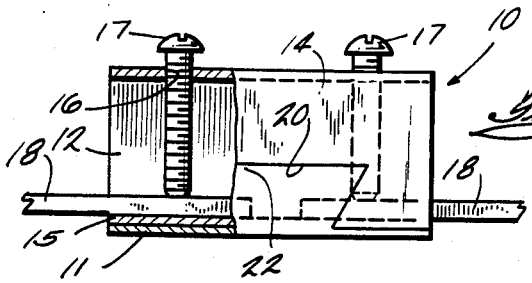
FIG. 3 is a side view of my complete device with two electrical conductors spliced by means of one end broken away to show the interior.

The blank 10 for the rectangular sleeve is provided with an opening 20 which in the preferred form is a regular trapezoid but could be of other forms which would lock the rectangular sleeve 10 against opening up when the screws 17 are tightened. The trapezoid shaped slot 20 crosses the fold line 21 which divides panel 14 from panel 15, so that when assembled as shown in FIGS. 1 and 3, side 14 has the dovetail slot extending all the way through the fold line, allowing the complementary dovetail 22 which forms a sixth panel of the blank to be folded to enter slot 20 when as rectangular sleeve 10 is folded from the form shown in FIG. 2 to the form shown in FIGS. 1 and 3. In this manner dovetail tab 22 lies flat within complementary dovetail slot 20 in a plane parallel to the axes of screws 17, and offers maximum resistance to the force developed by screws 17 on electrical conductors 18. If the fifth pabnel 15 were omitted fold line 21 would become a free edge, allowing dovetail slot 20 to receive dovetail panel 22.

I claim:

1. In an electrical connector comprising a rectangular sleeve, and openings in the sleeve receiving a pair of threaded electrical conductor clamping members having clamping ends, the improvement comprising: said sleeve being formed from a linear series of five main panels of which the first panel of the series and the last panel of the series overlap to form a single side of the rectangle, an opening in a side of the sleeve formed in a panel adjacent to the overlapping panels, the opening being narrowest nearest the clamping ends of the threaded clamping members, and a tab formed as a sixth panel adjacent to one of the overlapping panels at one end of the linear series of panels forming the sleeve which is complementary in shape to said opening and is placed in said opening during formation of the sleeve to prevent opening of the sleeve when the clamping members are clamped.

2. The device of claim 1 in which the opening is in the form of a trapezoid and the tab is in the form of a matching trapezoid.

3. The device of claim 1 in which the clamping members are screws received in screw threaded holes in a panel of the sleeve.

4. The device of claim 1, the panels of the linear series being joined at folds, in which the opening is an isosceles trapezoid lying across the fold between the adjacent panels of the rectangular sleeve to allow smooth folding of the dovetail into the opening.

* * * * *